United States Patent [19]

Weiss

[11] 4,228,649

[45] Oct. 21, 1980

[54] TIMING DEVICE

[76] Inventor: Gerhart Weiss, 76-70 172nd St., Flushing, N.Y. 11366

[21] Appl. No.: 969,035

[22] Filed: Dec. 13, 1978

[51] Int. Cl.[2] ..... B04F 1/06

[52] U.S. Cl. ..... 368/93; 368/94

[58] Field of Search ..... 58/2, 1 R, 53–55, 58/144; 29/177, 28 R, 33 D, 33 T, 422, 432, 522 R, 523; 264/138, 155, 159

[56] References Cited

U.S. PATENT DOCUMENTS

| | | | |
|---|---|---|---|
| 3,111,004 | 11/1963 | Allenbach | 58/144 |
| 3,166,839 | 1/1965 | Dock et al. | 58/144 X |
| 3,240,007 | 3/1966 | Dock et al. | 58/144 |
| 3,465,516 | 9/1969 | von Meter | 58/144 |
| 3,492,811 | 2/1970 | Shore | 58/144 |

*Primary Examiner*—Vit W. Miska

*Attorney, Agent, or Firm*—Blum, Kaplan, Friedman, Silberman & Beran

[57] ABSTRACT

A timing device comprises a container of a transparent material, a channel in said container, and a flotation liquid and a float in said channel, said float having a density different from that of said flotation liquid. Flotation liquid compositions are disclosed which provide a transit time of said float through said channel which is essentially independent of temperature over the normal ambient room temperature range. A number of the embodiments provide for adjustment of the transit times over a substantial range of times.

32 Claims, 14 Drawing Figures

FIG. 1
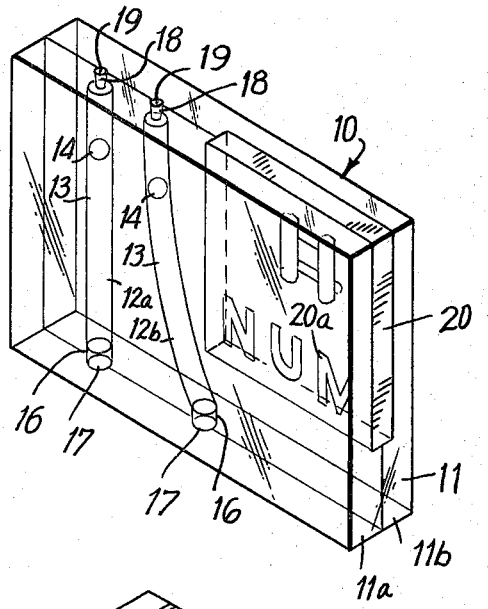
FIG. 2
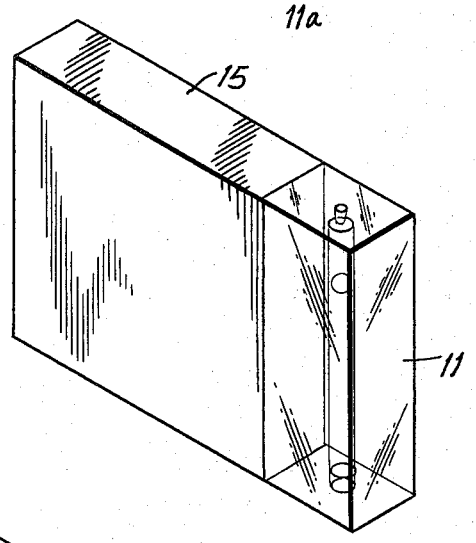
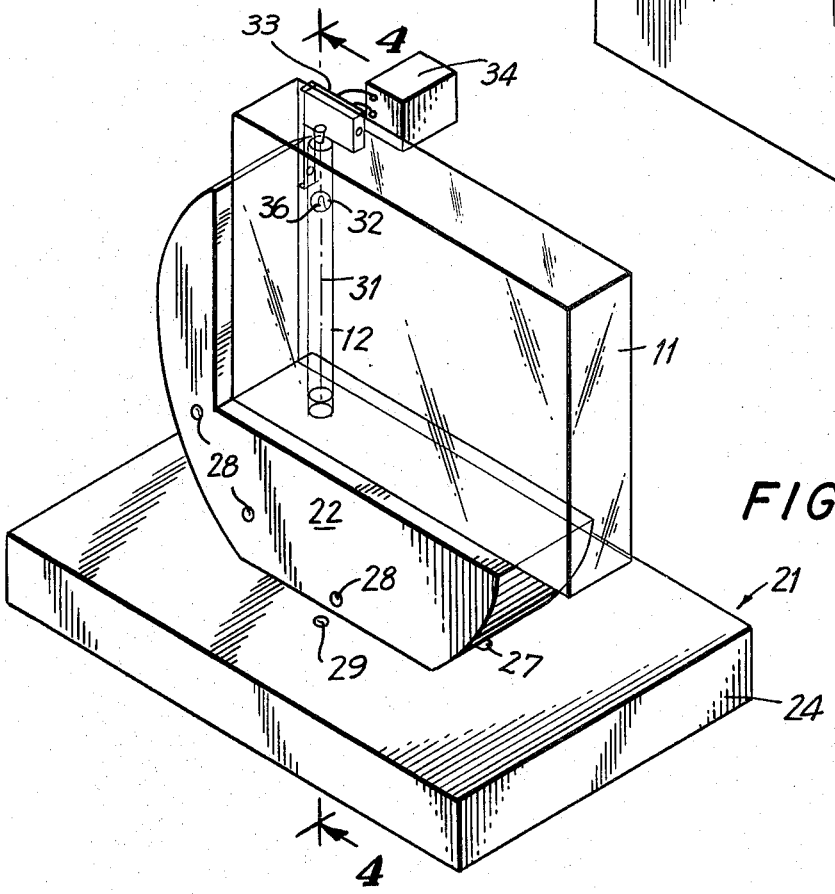
FIG. 3

TIMING DEVICE

BACKGROUND OF THE INVENTION

Timing devices which depend on the flow of a material through an orifice of a selected size are, of course, well-known. The commonest example is the hour-glass in which the material which flows through the orifice is a fine powder. However, as is obvious, similar devices dependent upon the flow of liquid through an orifice also can be used as timing devices. Also, the flow of liquid through an orifice has been used for other purposes, two such purposes being determination of the flow rate of the liquid and determination of the viscosity of the liquid. Peculiarly, both of these latter measurements depend upon orifices. This fact is surprising because measurement of the flow rate by the use of an orifice depends upon the fact that flow through a square-edged orifice is independent of viscosity, whereas determination of viscosity depends upon flow rate through an orifice in the form of a capillary. The contrast between these two types of measurements makes it clear that viscosity can give rise to problems in trying to measure the flow rate of a liquid where the orifice is other than square-edged. This problem has received considerable attention in the development of the variable-orifice flow meters which were originally known as rotameters, such meters being based upon the use of a plummet suspended by flowing liquid in a tube of gradual taper. The problem has been solved by the use of plummets of special configuration which, in effect, provide a variable orifice which has similarity to the square-edged orifice. Since such plummets are relatively expensive, attempts were made to use a spherical ball as the plummet. However, the spherical ball or float gives results which are sensitive to the viscosity of the liquid flowing through the meter. Then, since the viscosity of a liquid is strongly sensitive to temperature, the flow rate measurement provided by such a meter is likewise sensitive to temperature. Accordingly, it would appear that it would be difficult to provide a timer in which the transit time of a float through a flotation liquid is essentially independent of temperature, even taking into account the fact that liquids having a relatively low viscosity index (the rate of change of viscosity with temperature) are now available. Nevertheless, it would be desirable to be able to provide such a timer, especially without the necessity for the use of a plummet or float of complex profile.

SUMMARY OF THE INVENTION

A timing device in accordance with the present invention comprises a transparent container having a channel therein, and a flotation liquid and a float in said channel, said flotation liquid essentially filling said channel and said liquid preferably being sealed into said channel under a pressure of at least about 20 psig. Formation of gas bubbles is prevented by filling and maintaining the pressure in the channel at a value greater than the vapor pressure of the liquid in said channel at the maximum ambient temperature to which the liquid will be subjected. The flotation liquid consists essentially of a polydimethylsiloxane, a mineral oil and a halocarbon having a density of at least about 1.5. The preferred polydimethylsiloxanes have a viscosity of about 10 cs to 20 cs at 23° C., the preferred mineral oil has a viscosity of about 80 cs at 100° F., and the preferred halocarbon is polychlorotrifluoroethylene having an average molecular weight of about 560. The time of transit of the float through the channel containing said liquid is essentially independent of temperature over the range from about 2° C. to 40° C.

A preferred composition is 3 parts of polydimethylsiloxane having a viscosity of about 20 cs at 23° C., 1 part of mineral oil having a viscosity of about 80 cs at 100° F., and a quantity of polychlorotrifluoroethylene such as to provide the desired transit time.

Preferably, the channel is circular in transverse section, the float is spherical and has a diameter of about 0.187 inches, the inside diameter of said channel being about 0.218 inches, providing a total clearance between said float and said channel of about 0.031 inches. The preferred material for the container is polymethylmethacrylate and the preferred material for the float is also polymethylmethacrylate. It is desirable that the float be colored so that it can be seen readily. The float may be hollow, containing, for instance, a figure such as a minute clown. The float may couple electrically, or magnetically or electromagnetically to an external device such as a switch for activating a signal-generating means to show that the float has reached an end of the channel. The float may be of either higher or lower density than that of the liquid in the channel.

The transit time of the float from one end of the channel to the other can be increased by tipping the container so that the channel is in a position other than vertical. A base support provides for holding the timer stably in positions in which the channel is non-vertical. Also, the axis of the channel may be arcuate, and the cross-section of the channel may be other than circular, although a circular section is preferred. Arcuate channels and channels of section other than circular may be formed by joining two transparent blocks, each having a groove therein such that when the blocks are joined with said grooves in registry, a channel of desired section and shape is formed. Channels having at least two inwardly directed longitudinally-extending ribs present advantages over channel of circular cross-section from the standpoint of ease of manufacture and reproducibility.

Accordingly, an object of the present invention is a timing device based on the transit of a float through a cylindrical channel filled with liquid in which the time of transit is essentially independent of temperature.

Another object of the present invention is a timing device of simple construction employing a liquid having a low viscosity index, a mineral oil and a halocarbon for minimizing the effect of temperature on the transit time of a float through a channel.

A further object of the present invention is a timing device dependent upon transit of a float through liquid in a channel in which the index of refraction of the liquid is sufficiently close to that of the container so that the liquid has low visibility within the container.

An important object of the present invention is a timing device dependent upon the transit of a float through a liquid in a channel in a container which provides for display of objects including informational material and decorative material.

A significant object of the present invention is a timing device wherein completion of transit of a float through a channel can initiate an audible or visible signal.

Yet another significant object of the present invention is a timing device based on transit of a float through a channel where the transit time can be varied by adjusting the orientation of said channel with respect to gravity.

A most important object of the present invention is a timing device based on transit of a float through a channel in which the channel is non-circular in cross-section and is easy to manufacture reproducibly.

Still another object of the present invention is a method of manufacturing a timing device dependent upon the transit of a float through liquid in a channel in a container.

A particularly important object of the present invention is a composition for use in a timing device based on transit of a float through a channel containing said composition, said composition having the property of providing a transit time which is essentially independent of ambient temperature over a useful temperature range.

Still other objects and advantages of the invention will in part be obvious and will be apparent from the specification.

The invention accordingly comprises the several steps and the relation of one or more of such steps with respect to each of the others, the apparatus embodying features of construction, combinations and arrangements of parts which are adapted to effect such steps, and the product which possesses the characteristics, properties, and relation of components, all as exemplified in the detailed disclosure hereinafter set forth, and the scope of the invention will be indicated in the claims.

BRIEF DESCRIPTION OF THE DRAWINGS

For a fuller understanding of the invention, reference is had to the following description taken in connection with the accompanying drawings in which:

FIG. 1 is a perspective view of a timing device in accordance with the present invention showing both a straight and an arcuate channel;

FIG. 2 is a perspective view of another embodiment of the invention;

FIG. 3 is a perspective view of a timing device in accordance with the present invention including a support for holding said device at a selected angle to the vertical and an alarm means for indicating the completion of a transit of a float through a channel;

DESCRIPTION OF THE PREFERRED EMBODIMENTS

Figure 4:
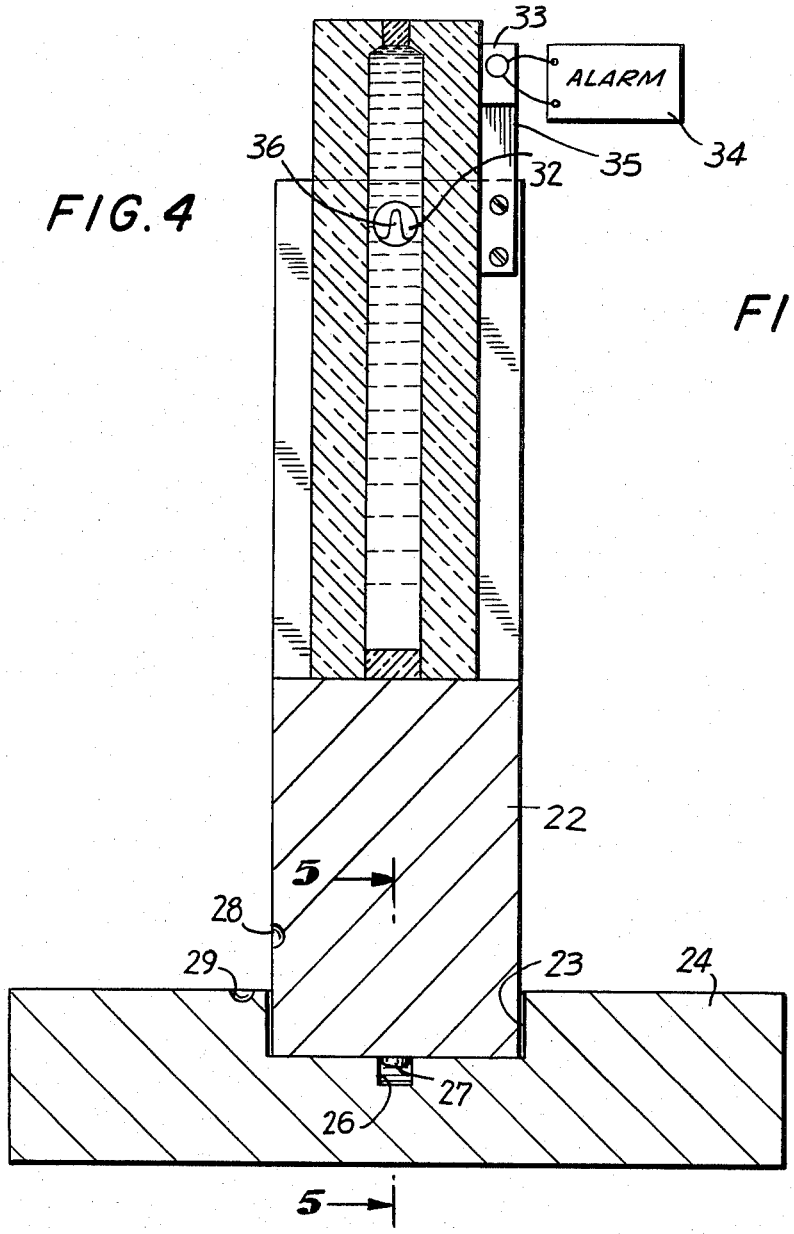
FIG. 4 is a view taken along line 4—4 of FIG. 3.

A timing device in aaccordance with the present invention is indicated generally by the reference numeral 10, said timing device comprising a container 11 which, in a preferred form, is a rectangular parallelepiped. The timing device as shown in FIG. 1 has two channels therein, 12*a* and 12*b*, channel 12*a* being straight and channel 12*b* being arcuate. It is to be understood that said timing device in the embodiment of FIG. 1 may have therein either or both of said channels. Each of the channels has therein a flotation liquid 13 and a float 14, flotation liquid 13 completely filling the channel except for the space occupied by the float. The cross-section of each of the channels, for certain purposes, which will be described below, is preferably, but not necessarily, circular and the float is sized so that it can move with a selected clearance through the channel. The container 11, as is evident, must be transparent so that the float 14 can be seen therethrough. The float is introduced into the channel through an opening 16 connecting the channel with a surface of the container and the opening is sealed permanently thereafter by sealing a plug 17 into said opening.

Cylindrical channel 12*a* can be formed by drilling said channel from the bottom surface of container 11 as viewed in FIG. 1. Preferably, the drilled channel is then either broached or gun-drilled in the interest of greater precision and accuracy. To form the arcuate channel 12*b*, container 11 is made in two halves 11*a* and 11*b* and grooves are formed in corresponding faces of said halves. The grooves are disposed so that when the halves are united, the grooves will form the channel 12*b*. As is evident, the grooves can have any desired shape both so far as the shape of the axis is concerned and so far as the cross-section of the channel is concerned. Accordingly, a transverse section through groove 12*b* need not be circular, and the same is true for channel 12*a* if container 11 is made in two halves as described or if said channel is broached.

To fill either of the channels, flotation liquid 13 is introduced through opening 18 by means of a hypodermic syringe (not shown) after which a small plug 19, which preferably is tapered, is forced into opening 18 to seal it. It is not necessary to use a cement or other sealant. Plug 19 is introduced under conditions such that no air remains in the channel and such that the liquid therein is subjected to a pressure which exceeds the vapor pressure of flotation liquid 13 at the maximum temperature which the device will encounter, in which case no bubbles can form. The preferred minimum pressure on the liquid is about 20 pounds per square inch gauge.

Where the device is made in two sections from halves 11*a* and 11*b* as described above, the halves can be joined as by the use of a transparent cement, acetic acid, for instance, serving for joining the halves when the halves are made of methylmethacrylate. A preferred method for joining the halves is by sonic welding, this technique avoiding the formation of bubbles between said halves.

The technique of forming container 10 in sections makes it possible to incorporate with great ease an insert such as that given the reference numeral 20. The purpose of insert 20 is to carry decorative or advertising material, such material being indicated by the faint characters given the reference numeral 20*a*.

The transit time of the float through the channel from one end to the other end thereof depends upon the difference in density between the float and the flotation liquid, the clearance between the float and the wall of the channel, the viscosity of the flotation liquid and the inclination and transverse section of the channel. Furthermore, the densities of the float and the flotation liquid can be selected so that transit takes place either in the upward direction or in the downward direction depending upon which of the densities is greater.

As aforenoted, it would be expected that the transit time will depend upon the temperature, since the viscosity of the flotation liquid will vary with temperature. However, I have found that by proper selection of the flotation liquid a transit time which is essentially independent of temperature over the normal range of room temperature can be achieved. It appears likely that this independence is achieved by balancing several factors such as change in viscosity and differential changes in density with temperature, but the relationships among the various factors are non-linear and sufficiently complex so that a complete analysis of the functional relationship between temperature and transit time is difficult. Further problems with respect to the composition arise from the fact that the appearance of the device is degraded if the index of refraction thereof varies too greatly from that of the container and from the fact that two of the components are only partly miscible in the absence of a third component. Accordingly, my invention is not to be considered as being dependent upon any specific mechanism or functional relationship between the various factors which influence and control the transit time.

In order to minimize the effect of temperature, I use, as one component of the flotation liquid, a liquid having a low viscosity index. The preferred liquid is a polydimethylsiloxane of a molecular weight such that it has a viscosity of about 10 to about 20 centistokes at 23° C. Such a liquid is manufactured and sold by Dow-Corning and sold as Dow-Corning 200 Fluid. As the second component of the flotation liquid I use a mineral oil, that sold by A. Margolis and Sons Corporation under the name of Silogram, white oil 355 being preferred. This mineral oil has a viscosity of about 80 centistokes (cs) at 100° F. and 7.7 cs at 200° F. The siloxane and oil are only partly miscible at room temperature. The third ingredient is a halocarbon of high density, the purpose of this ingredient being to increase the density of the flotation liquid to a value such as to yield the desired transit time and to render the other components miscible. The preferred halocarbon is polychlorotrifluoroethylene having a molecular weight of about 560 and sold by Halocarbon Products as Halocarbon 4–11. The degree of polymerization of the Halocarbon 4–11 is about 4, with virtually all of the material having a degree of polymerization between 3 and 5.

Figure 13:
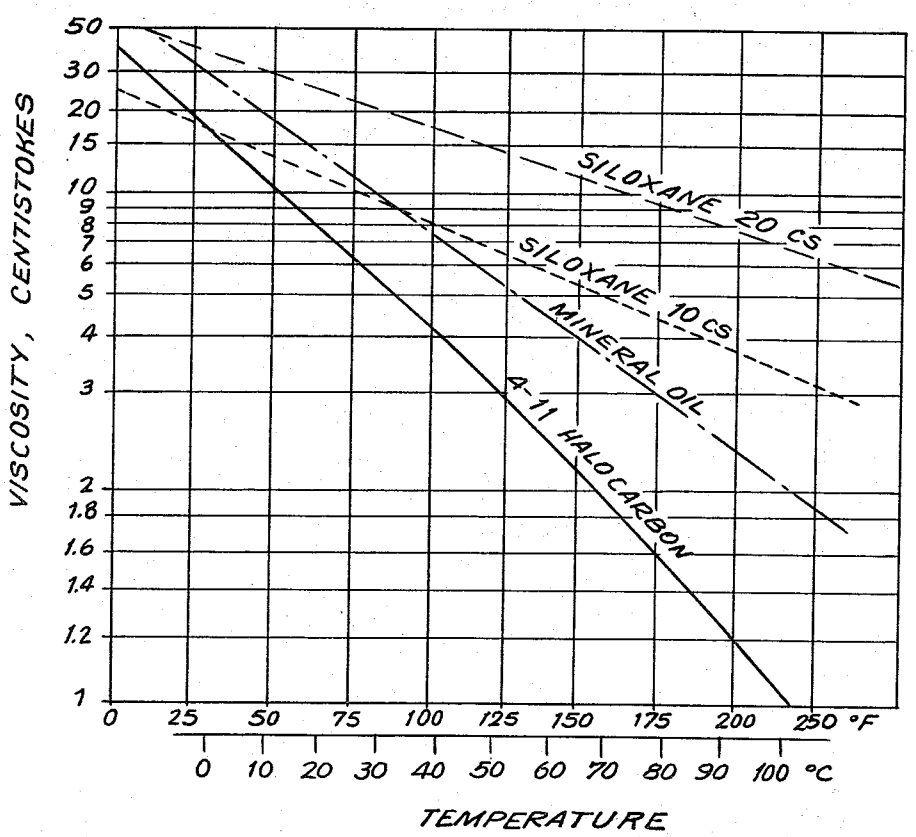
FIG. 13 shows the individual viscosities as a function of temperature of three ingredients comprising the flotation liquid of the present invention.

The individual viscosities of the three materials are shown in FIG. 13. As is evident, the dependence of viscosity on temperature is smallest for the siloxane and greatest for the halocarbon. However, the viscosities of all three materials are nevertheless pronouncedly dependent upon temperature, so that it must be considered surprising that a timing device which is essentially independent of temperature can be based upon a composition consisting of these three ingredients.

Figure 14:
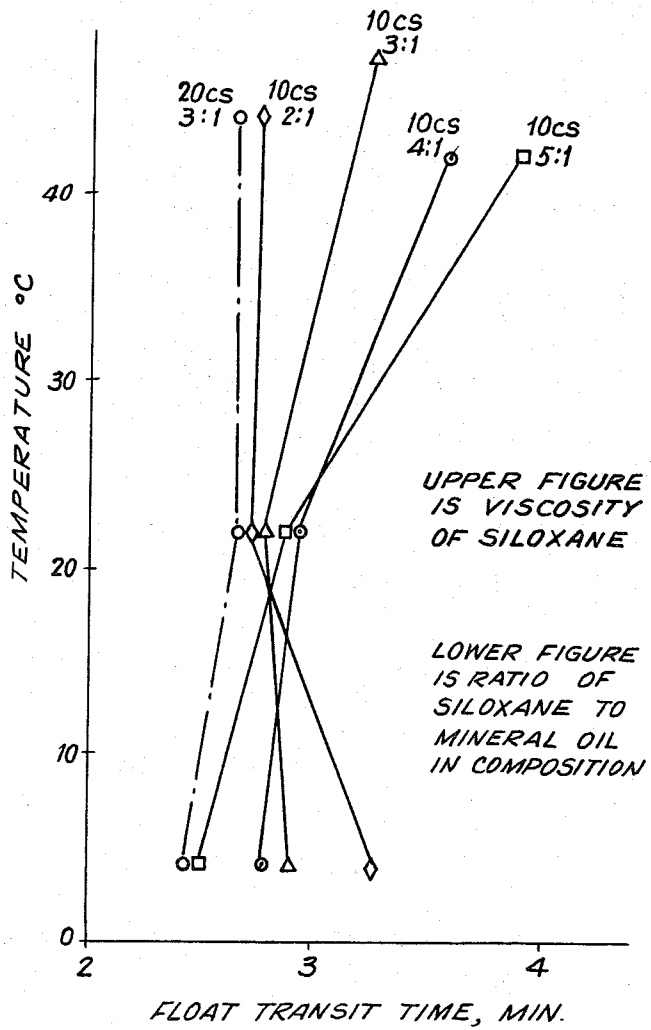
FIG. 14 shows viscosity as a function of temperature of ternary compositions in accordance with the present invention, said compositions comprising a siloxane having a low viscosity index, a hydrocarbon oil and a halocarbon.

FIG. 14 shows rise times of a float in a specific vertical, cylindrical channel for compositions consisting of 10 cs and 20 cs siloxanes, the mineral oil and enough of the halocarbon, to bring the rise time to a convenient value. The length of the channel was $2\frac{5}{8}$ inches, the diameter of the cylindrical channel was 0.218 inches. Both the float and the container were of methylmethacrylate, and the container was positioned so that the channel was vertical. The compositions which were tested are given in Table 1.

TABLE 1

| Ex. | | |
|---|---|---|
| 1. | Silicone 200–20 cs | 3 parts |
| | Marcol Silogram 355 | (Mineral Oil) 1 part (index = 1.4805 at 20° C.) |
| | Halocarbon 4–11 | approx. 1.7 parts to make d = 1.215. |
| 2. | Silicone 200–10 cs | 5 parts |
| | Marcol Silogram 355 | 1 part |
| | Halocarbon 4–11 | to adjust time. |
| 3. | Silicone 200–10 cs | 4 parts |
| | Marcol Silogram 355 | 1 part |
| | Halocarbon 4–11 | approx 5 parts to make oil mix = 1.205. |
| 4. | Silicone - 10 cs | 3 parts |
| | Marcol Silogram 355 | 1 part |
| | Halocarbon 4–11 | to adjust time. |
| 5. | Silicone - 10 cs | 2 parts |
| | Marcol Silogram 355 | 1 part |
| | Halocarbon 4–11 | to adjust time. |

As will be noted, the quantity of Halocarbon 4–11 is not specified in three of the examples. The reason is that the quantity of Halocarbon 4–11 present in the composition does not affect sensitivity to temperature. The quantity of halocarbon is, however, critical with respect to the transit time of the float through the channel. Thus, increase in the quantity of halocarbon where the transit is upwardly through the channel increases the density of the composition and therefore decreases the rise time.

In general, higher viscosity siloxanes are preferred because they provide greater reproducibility from unit to unit; in other words, they are less sensitive to variations in the clearance between the float and the interior of the channel. However, the higher viscosities are more sensitive to variation in temperature. The preferred range of viscosities is between about 5 cs and 25 cs. Viscosities as high as 100 cs have been tested and although siloxanes having a viscosity anywhere within the range of about 5 to 100 cs can be used, the range of 5 to 25 cs is preferred and within this range, the siloxane having a viscosity of 20 cs at 23° C. has been found to be the optimum with respect to both reproducibility and freedom from variation due to change in temperature.

FIG. 14 illustrates a number of factors involved in formulating the preferred compositions. Thus, as can be seen from the curves for the 10 cs siloxane composition, increasing the ratio of siloxane content to mineral oil content increases the sensitivity of the device to temperature. Nevertheless, the composition comprising 2 parts of 10 cs siloxane to 1 part of mineral oil, all parts being by volume, gives excellent results over the range of 22° C. to 44° C. For most purposes, this range is more important than the range from 4° C. to 22° C. because of the fact that dwellings are generally maintained in the upper range rather than the lower. A further advantage of the low ratio of the siloxane to the mineral oil is that the index of refraction of the composition is closer to that of methylmethacrylate so that the visibility of the solution is very low.

The siloxane having the 20 cs viscosity when used with mineral oil in a ratio of 3:1 also provides excellent freedom from change induced by temperature change over the temperature range of 22° C. to 44° C. Furthermore, the effect of temperature over the range from 4° C. to 22° C. is even smaller than that for the 2:1 composition based on 10 cs viscosity siloxane. As aforenoted, the 3:1 composition based on 20 cs viscosity siloxane is the best that has been found up to this point. The quantity of Halocarbon 4–11 used was 1.7 parts by volume for 3 parts by volume of the siloxane (Silicone 200). However, as aforenoted, the Halocarbon 4–11 has no effect on the temperature-dependence of the device, but, instead, controls the transit time by affecting the density of the mix. It also decreases the viscosity of the compositon so that where the transit is upward, increasing the content of halocarbon in the mix reduces the transit time both by reducing the viscosity and by increasing the difference in density between the mix and the float.

Other halocarbons can, of course, be used. However, selection must be made carefully since the flotation liquid must not attack either the float or the container. Suitable materials for the container are polymethylmethacrylate, polycarbonate, and other transparent synthetic resins, colorless resins being preferred. Where the container is colorless, it is desirable that the float be colored so that it can be readily seen. The material of the float need not be the same as that of the container. Suitable materials are phenolic resins, polymethylmethacrylate, polycarbonate, or any synthetic resin which can be molded or cut to size and shape, so long as the material is not attacked in any way by the flotation liquid. Naturally, neither the container nor the float may be soluble in the flotation liquid. Also, it is desirable that neither absorb the flotation liquid.

The container 11 need not constitute the entire device, but need only be sufficient to encompass the channel, such embodiments being shown in FIGS. 2 and 8–11. In the embodiment of FIG. 2, container 11 is attached to a block 15 which may be of wood, a different plastic or metal, either mechanically or by cement.

Figure 5:
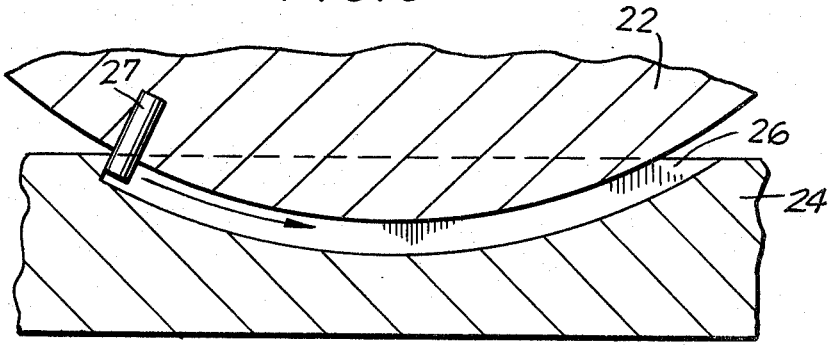
FIG. 5 is a view taken along line 5—5 of FIG. 4.

The time of transit of the float through the channel is at a minimum, of course, when the channel is in vertical position. The time of transit can be increased by arranging to support the container in a position such that the orientation of axis 31 of the cylindrical channel is no longer vertical. A support 21 for holding the container in such a non-vertical orientation is shown in FIGS. 3–5, the support including a notched disc 22 which rests in a groove 23 in base 24. Groove 23 may have a slot 26 for receiving peg 27. Also, disc 22 may have index markings of any of a variety of types. For instance, disc 22 is shown in FIG. 3 as having indicia 28 thereon in the form of colored dots, the purpose of same being to make it possible to select a specific orientation of the disc and of the channel 12 in container 11 by aligning one of the dots 28 with reference dot 29 on base 24. As is evident, disc 22 could be marked in degrees from the vertical or in transit times corresponding to specific inclinations from the vertical. An important feature which may be incorporated in any of the embodiments taught herein is shown in FIG. 3, said important feature being an electromagnetic sensor which can generate a signal indicating that float 32 has reached a selected region in channel 12 during transit therethrough. In the embodiment shown in FIG. 3, the electromagnetic sensor is in the form of a reed switch 33 connected electrically to a signal generator 34 which may be constructed for generating either a visible or an audible signal. In the embodiment of FIGS. 3 and 4, reed switch 33 is supported on notched disc 22 by bracket 35 which is attached to notched disc 22. Reed switch 33 is activated by the approach of magnet 36 contained in float 32.

Figure 6:
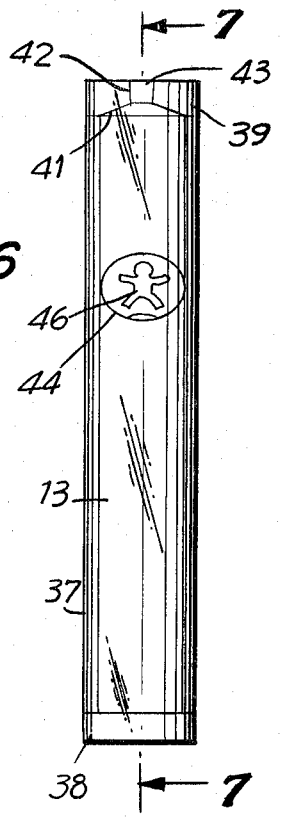
FIG. 6 is another embodiment of the invention.

In the embodiments of FIGS. 1–3, container 11 constitutes a major portion of the device. An embodiment of substantially lower cost is shown in FIG. 6 in which the container is an extruded tube. In general, the diameter and configuration of the interior surface of the tube cannot be controlled with sufficient precision in the extrusion process so that subsequent shaping of the interior of the tube is necessary. This shaping can be effected either by broaching or by gun-drilling, the latter, in general, being preferred. The tube section 37 shown in FIG. 6 is closed at the bottom end by base 38 and at the top end by cap 39 having a conical cavity for bringing any air or gas bubbles directly beneath opening 42 in cap 39 during the filling operation. Opening 42 is sealed with tapered plug 43 which is forced inwardly until the pressure on flotation liquid 13 exceeds the vapor pressure of the flotation liquid over the range of ambient temperatures which it is expected that the device will encounter.

Spherical float 44, of couse, is introduced into tube section 37 before the tube is completely enclosed. In the embodiment of FIG. 6, float 44 is shown as containing therein a manikin 46 for decorative or amusement purposes.

Figure 7:
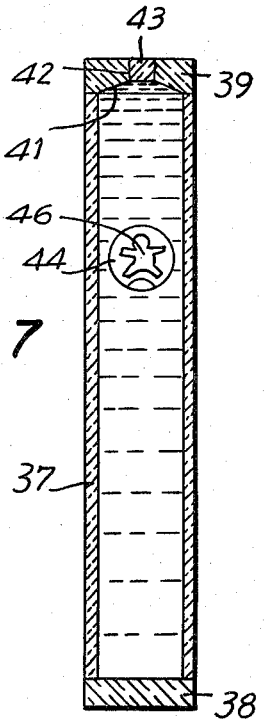
FIG. 7 is a view taken along line 7—7 of FIG. 6.

Float 44, as aforenoted, is spherical, but it is represented in FIG. 6 as appearing to be elliptical, this appearance being due to the magnifying effect of the cylindrical tube 37. In the sectional view of FIG. 7, float 44 is shown as being spherical, its true shape.

Figure 8:
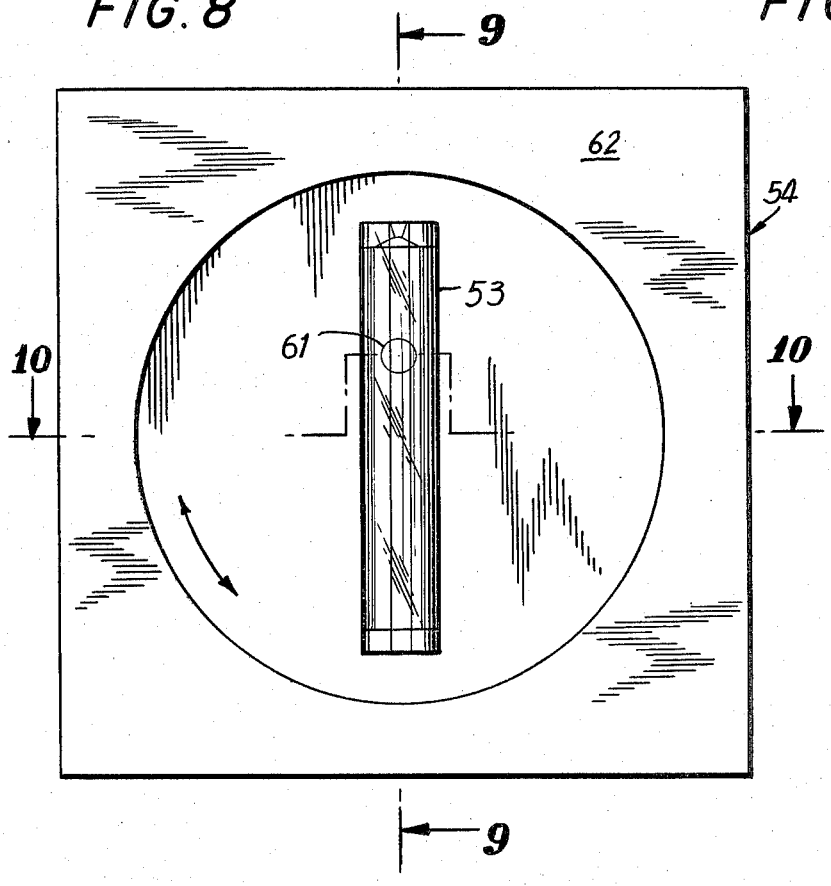
FIG. 8 is a front view of another embodiment of the invention.
Figure 9:
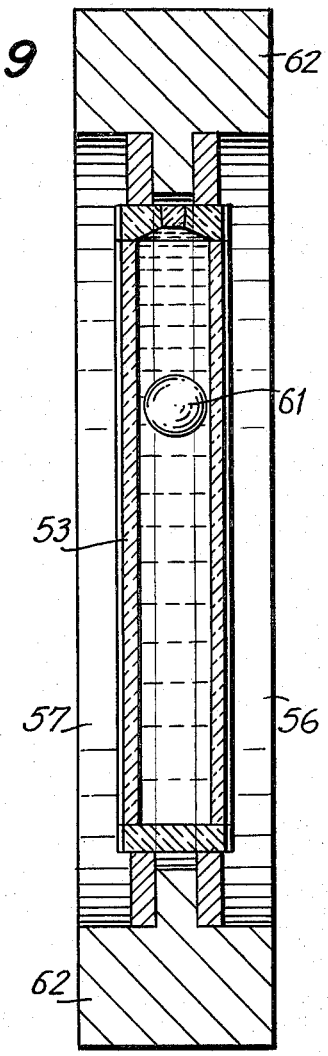
FIG. 9 is a view taken along line 9—9 of FIG. 8.
Figure 10:
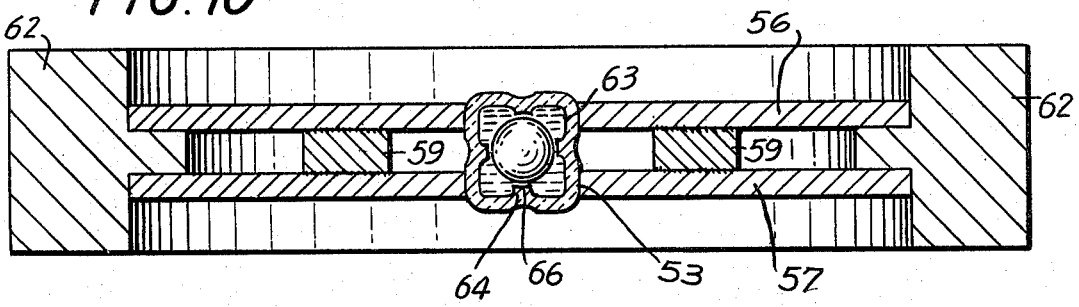
FIG. 10 is a view taken along broken line 10—10 of FIG. 8.
Figure 11:
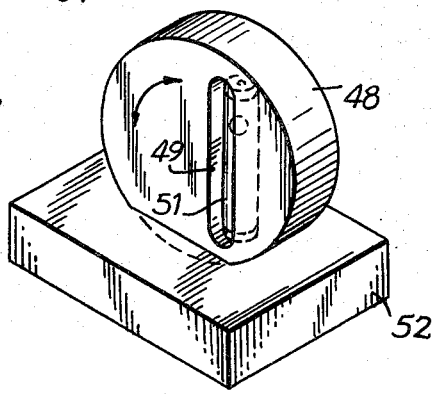
FIG. 11 is a perspective view of still another embodiment of the invention incorporating the embodiment of FIG. 6.

Tubular embodiments may be vended and used as such. However, it is preferable that they be provided with an appropriate support. Such supports are shown in FIGS. 8 and 11. The support embodiment of FIG. 11 is the simpler and consists merely of a disc 48 having a cavity 49 therein into which a tubular embodiment can be inserted. The disc can be held in a groove in a base 52 in a manner similar to that of the embodiments of FIGS. 3–5. In the embodiment of FIGS. 8–10, tubular model 53 is held in a support indicated generally by the reference numeral 54 which comprises a rectangular block 62 having a cylindrical opening therein and two plates 56 and 57 spaced apart by wood strips 59 which are bonded to said plates. Plates 56 and 57 are apertured so that tubular model 53 and float 61 therein are visible. Plates 56 and 57 with the tubular model 53 therebetween are rotatably supported in rectangular block 62.

FIG. 10 illustrates a significant feature of the present invention, said feature being the fact that the interior surface 63 of tube 53 need not be circular. Tube 53 has four ridges 64 projecting inwardly and extending the length of tube 53. After forming of the tube a gun-drill or broach is passed through the tube to form crests which, in cross-section, are all arcs of the same circle. The advantage of forming the interior of the tube in this way lies principally in the decreased wear of the broach or gun-drill. Both broaches and gun-drills wear rapidly during machining of plastics such as methylmethacrylate. Through the use of a construction such as shown in FIG. 10, the broach and, the gun-drill is required to do less cutting per unit of length. It has been found that sharpening of the broach or gun-drill constitutes a major factor in the overall cost of the product so that reduction in the wear of these sizing tools resulting from the non-circular shape of tube 53 produces a substantial reduction in the final cost of the product. The minimum number of ridges which can hold a spherical ball in place is two but the use of only two ridges requires that the length of the arcs in each of the ridges be rather large. Preferably, the number of ridges should be either three or four, three ridges providing for precise location of the spherical ball with relatively short arcs. The same is true for a tube having four ridges. While a larger number of ridges can be used, the ridges then begin to approximate serrations.

Although the floats are shown as being spherical, the factors which control the rise time are equally applicable to cylindrical floats. Accordingly, it is to be recognized that the invention is not restricted to spherical floats but, rather, to floats having either a cylindrical or a spherical section which provides the major resistance to movement of the float through the liquid, said resistance arising from the close clearance between the operational portion of the float and the interior wall of the channel.

Figure 12:
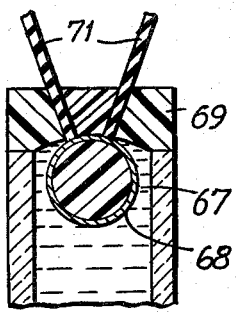
FIG. 12 shows the embodiment of FIG. 9 modified for closing an electrical contact and generating a signal at completion of a transit by a float.

A further example of an embodiment in which the arrival of a float at a selected portion of the channel can be used to generate a signal is shown in FIG. 12 in which float 67 has a conductive coating 68 thereon. Molded into plastic cap 69 are leads 71. These, preferably, are of conductive rubber which offers no problems with respect to difference in coefficient-of-expansion as is the case with metal leads. Nevertheless, metal leads can be introduced through the wall of the device. Also, as is evident, leads 71 could be introduced in such form that float 67 could bring about contact therebetween by moving one of said leads into physical continuity with the other through the flotation force on said float. An appropriate circuit can also be based on capacitance change.

It will thus be seen that the objects set forth above, among those made apparent from the preceding description, are efficiently attained and, since certain changes may be made in carrying out the above process, in the described products, the described constructions, and in the described compositions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A timer, comprising a container having an elongated channel therein, said channel having two closed ends and an axis, a float in said channel, said float being sized to move with clearance from one end of said channel to the other, and a flotation liquid essentially filling said channel with said float therein, said flotation liquid comprising a polydimethylsiloxane oil, having a viscosity between about 5 and 25 centistokes (cs) at room temperature, a mineral oil and a sufficient quantity of a halocarbon having a density of at least 1.5 to yield a selected transit time of said float from one end of said channel to the other when the axis of said channel is in a selected non-horizontal orientation, the relative quantities of said siloxane oil and said mineral oil being such that said transit time is substantially independent of temperature.

2. A timer as defined in claim 1, wherein said float is spherical.

3. A timer as defined in claim 1, wherein said flotation liquid is denser than said float for providing that transit takes place upwardly.

4. A timer as defined in claim 1, wherein the density of said flotation liquid is less than that of said float for providing that transit takes place downwardly.

5. A timer as defined in claim 1, wherein said liquid is sealed within said channel at a pressure of at least about 20 psig.

6. A timer as defined in claim 1, wherein said float is of a material selected from the group consisting of organic resins insoluble in and unaffected chemically by said flotation liquid, and glass, said float when of glass being hollow.

7. A timer as defined in claim 6, wherein said float is of polymethylmethacrylate.

8. A timer as defined in claim 6, wherein said float is colored for providing visibility of same in said flotation liquid.

9. A timer as defined in claim 1, wherein that portion of said container having said channel therein is of a transparent organic resin insoluble in and unaffected chemically by said flotation liquid.

10. A timer as defined in claim 9, wherein said container is of polymethylmethacrylate.

11. A timer as defined in claim 1, wherein said container is in rectangular parallepiped form.

12. A timer as defined in claim 1, further comprising support means for holding said container so that said axis of said channel is at a selected angle to the vertical.

13. A timer as defined in claim 1, wherein said axis of said channel is arcuate.

14. A timer as defined in claim 1, comprising means for generating a signal when said float reaches a selected region in said channel during transit thereof.

15. A timer as defined in claim 14, wherein said signal-generating means comprises a magnet in said float and a switch means disposed exterior to said channel, said switch means being activatable by approach of said magnet in said float.

16. A timer as defined in claim 14, wherein said signal-generating means comprises switch means disposed at a selected region in said channel said switch means being activatable by contact with said float transitting said channel.

17. A timer as defined in claim 1, wherein one end of said channel is sealed with a plug having an essentially conical hollow at its inner face for facilitating collection and removal of air in filling said channel with said flotation liquid.

18. A timer as defined in claim 1, wherein the interior surface of said channel includes at least two inwardly-directed ridges extending lengthwise of said channel, the crests of said ridges being shaped for guiding said float in its transit along said channel and providing a selected clearance between said crests and said float.

19. A timer as defined in claim 18, wherein said crests, in cross-section, are arcs of a single circle.

20. A timer as defined in claim 1, wherein said container has the form of a transparent tube closed at both ends.

21. A timer as defined in claim 20, further comprising opposed plates for holding said tube therebetween, at least one of said plates having a slot therein for exposing said tube and float therethrough, and fastening means for holding said plates together.

22. A timer as defined in claim 21, further comprising support means for holding said plates and said tube at a selected angle to the vertical.

23. A timer as defined in claim 1, further comprising decorative material within said float.

24. A timer as defined in claim 1, wherein said float is spherical and has a diameter of about 0.187 inches, said channel is circular in cross-section and the inside diameter of said channel is about 0.218 inches, providing a total clearance between said float and said channel of about 0.031 inches.

25. A timer as defined in claim 1, wherein said container is constructed for holding removably external to said channel, an object other than said flotation liquid.

26. A timer as defined in claim 25, wherein said object includes informational material.

27. A timer as defined in claim 25, wherein said object includes decorative material.

28. A timer as defined in claim 1, wherein said halocarbon is polychlorotrifluoroethylene having an average molecular weight of about 560, said polydimethylsiloxane has a viscosity between about 5 and 25 centistokes (cs) at 23° C. and said mineral oil at 38° C. and 93° C. has viscosities of about 80 and 7.7 cs respectively.

29. A timer as defined in claim 28, wherein said flotation liquid consists, apart from minor impurities, essentially of 1–5 parts by volume of polydimethylsiloxane having a viscosity of about 10 cs at 23° C.; 1 part by volume of said mineral oil, and sufficient polychlorofluorotrifluoroethylene having an average molecular weight of about 560 to adjust the transit time of said float to a selected value.

30. A timer as defined in claim 28, wherein said flotation liquid consists, apart from minor impurities, essentially of 2 parts by volume of polydimethylsiloxane having a viscosity of about 10 cs at 23° C., 1 part by volume of said mineral oil, and a sufficient quantity of polychlorotrifluoroethylene having an average molecular weight of about 560 to adjust the transit time of said float to a selected value.

31. A timer as defined in claim 28, wherein said flotation liquid consists, apart from minor impurities, essentially of 3 parts by volume of polydimethylsiloxane having a viscosity of about 20 cs at 23° C., 1 part by volume of said mineral oil and a sufficient quantity of polychlorotrifluoroethylene having an average molecular weight of about 560 to adjust the transit time of said float to a selected value.

32. A timer as defined in claim 31, wherein said float and said container are of polymethylmethacrylate and the quantity of said polychlorotrifluoroethylene is such as to make the density of said liquid about 1.215 g/ml.

* * * * *